US010252896B2

(12) United States Patent
Schneebeck et al.

(10) Patent No.: US 10,252,896 B2
(45) Date of Patent: Apr. 9, 2019

(54) LIFTING GEAR

(71) Applicant: COLUMBUS MCKINNON INDUSTRIAL PRODUCTS GMBH, Wuppertal (DE)

(72) Inventors: Wolfram Schneebeck, Wuppertal (DE); Detlef Struck, Wuppertal (DE)

(73) Assignee: COLUMBUS MCKINNON INDUSTRIAL PRODUCTS GMBH, Wuppertal (DE)

( * ) Notice: Subject to any disclaimer, the term of this patent is extended or adjusted under 35 U.S.C. 154(b) by 0 days.

(21) Appl. No.: 15/566,920

(22) PCT Filed: May 27, 2016

(86) PCT No.: PCT/DE2016/100246
§ 371 (c)(1),
(2) Date: Oct. 16, 2017

(87) PCT Pub. No.: WO2016/192713
PCT Pub. Date: Dec. 8, 2016

(65) Prior Publication Data

US 2018/0099845 A1 Apr. 12, 2018

(30) Foreign Application Priority Data

May 29, 2015 (DE) ..... 20 2015 102 783 U

(51) Int. Cl.
*B66D 3/14* (2006.01)

(52) U.S. Cl.
CPC ..... *B66D 3/14* (2013.01)

(58) Field of Classification Search
CPC .... B66D 3/14; B66D 3/02; B66D 1/04; Y10T 74/20618; Y10T 74/20756
See application file for complete search history.

(56) References Cited

U.S. PATENT DOCUMENTS

| | | | | | |
|---|---|---|---|---|---|
| 1,673,297 | A | * | 6/1928 | Moreno | B66D 3/14 254/343 |
| 2,243,361 | A | * | 5/1941 | Stahl | B66D 3/14 192/16 |
| 2,343,884 | A | * | 3/1944 | Coffing | B66D 3/14 192/16 |
| 4,156,521 | A | * | 5/1979 | Harman | B66D 5/22 188/82.9 |

(Continued)

FOREIGN PATENT DOCUMENTS

DE 4105050 A1 8/1992

OTHER PUBLICATIONS

International Search Report for No. PCT/DE2016/100246, dated Oct. 19, 2016, 9 pages.

(Continued)

*Primary Examiner* — Michael E Gallion
(74) *Attorney, Agent, or Firm* — Hauptman Ham, LLP

(57) ABSTRACT

The invention relates to a lifting gear having a flexible drive and a traction drive movable by the flexible drive. The flexible drive can be actuated by a lever arm arranged to pivot, and in the region of the free end of the lever arm, a handle is connected to the lever arm by an articulated joint. The handle can be pivoted from a starting position into an operating position.

11 Claims, 4 Drawing Sheets

(56) References Cited

U.S. PATENT DOCUMENTS 4,218,046 A * 8/1980 Bathum, Jr. ..... B66D 1/58 254/266
4,260,136 A * 4/1981 Harman ..... B66D 3/26 254/372
4,422,218 A * 12/1983 Brasseux ..... B60P 7/0838 24/270
4,531,715 A 7/1985 Wiens
4,552,034 A * 11/1985 Bertani ..... G05G 1/087 403/111
D315,976 S * 4/1991 Shieh ..... D34/33
5,156,377 A * 10/1992 Nishimura ..... B66D 3/14 192/43.1
5,443,570 A * 8/1995 Hirano ..... A01K 89/009 242/284
6,945,516 B1 * 9/2005 Scott ..... B60P 7/083 254/231
7,513,484 B1 * 4/2009 Selby ..... B66D 3/02 254/243
7,891,271 B2 * 2/2011 Grant ..... B62K 23/08 123/185.5
9,453,557 B2 * 9/2016 Chou ..... F16G 11/12
D770,122 S * 10/2016 Mayer ..... D34/33
D772,032 S * 11/2016 Durbin ..... D8/44
2006/0278861 A1 * 12/2006 Leslie ..... B66D 1/04 254/333
2007/0137404 A1 * 6/2007 Bertani ..... G05G 1/04 74/523
2010/0193755 A1 * 8/2010 Klasing ..... B61H 13/04 254/345
2014/0061556 A1 * 3/2014 Knox ..... B60P 7/0846 254/220

OTHER PUBLICATIONS

Office Action in RU Application No. 2017134399/11(060553) dated Jul. 9, 2018, 8pp.

* cited by examiner

LIFTING GEAR

CROSS REFERENCE TO RELATED APPLICATIONS

The present application is a National Phase of International Application Number PCT/DE2016/100246 filed May 27, 2016 and claims priority benefits from German Patent Application Number 20 2015 102 783.4 filed May 29, 2015.

BACKGROUND

1. Field of the Invention

The disclosure is related to a lifting gear, and more specifically to a lever hoist, including a traction drive and a traction mechanism movable by the traction drive.

2. Description of the Related Art

A lifting gear is known from DE 41 05 050 A1. The lifting gear indicated there, also known as a pulling tackle, consists substantially of an upper fastening element and a lower abutment element, which are joined together indirectly via a housing. The abutment element is connected via a traction means to a traction drive, which is located in the housing of the lifting gear. By moving a swivel arm, the traction drive can be placed in rotation inside the housing. In this way, it is possible to move an object or to lash a traction means around an object.

The lever arm engages in a gear mechanism, which in turn is connected to the traction drive and thus sets the traction drive in motion by a swivel movement of the lever arm. But the lever arm, depending on the position of the operator, is often not in an ergonomically favorable position.

SUMMARY

Starting from the prior art, the problem which the invention proposes to solve is to create a lifting gear which is improved in terms of application technique and ergonomics, and which should also simplify the use with heavy loads.

According to one exemplary embodiment, a lifting gear, particularly a lever hoist, comprises a traction drive and a traction means movable by said traction drive, wherein the traction drive can be actuated by a lever arm arranged such that it can swivel.

The lifting gear is mounted in a housing, while at least one fastening element and an abutment element are coupled indirectly to the housing.

The housing is at least partly open in its design. This means that the housing is formed by two metal plates configured parallel to a longitudinal axis of the lifting gear, which are joined together across a frame structure. This contributes to a simple and light construction.

The housing may also be designed closed except for the necessary openings for the traction means and for the attachment of the fastening element.

Inside the housing is the traction drive, which is connected to a lever arm across a gearing arrangement which is known from the prior art. By a swiveling of the lever arm it is possible to actuate the traction drive so that the traction means located therein can move. The traction means is preferably a chain or a rope or wire. The traction drive is then configured preferably as a chain wheel or a rope drum, which stands in connection with the lever arm across a gearing arrangement. The traction means designed as a chain can be moved via the chain wheel.

By swiveling the lever arm, a rotary movement is transmitted across the gearing to the traction drive, so that the traction means can be moved by the traction drive.

At the free end of the lever arm a handle is connected to the lever arm by means of an articulated joint, wherein the handle can swivel from a starting position to an operating position. Whenever the operator so chooses, he can swivel the handle from its starting position into an operating position. In this way, the operator can grasp the lever arm in a different way and actuate it in a better way, i.e., transmit forces in a more ergonomically favorable manner to the lifting gear. Furthermore, the swivel range of the hand lever can be better utilized.

The handle can be swiveled into several operating positions, depending on its starting position. In this way, it is possible to respond to application-specific requirements; for example, to make possible operation by a left-handed or right-handed person.

Preferably, the lever arm has a recess in which the handle is arranged in its starting position. In this way, it is possible to have a compact design of the lifting gear, so that when not in use it takes up little space.

The handle can be arranged between two spaced-apart webs of the lever arm. A swivel axle for the handle can extend between the webs.

Furthermore, another embodiment calls for providing only one web on the lever arm, and arranging the handle next to the web. Depending on the design of the articulated joint, the handle may swivel about one or two axles.

When the handle is in its folded-up starting position, this is advantageous not only for the storage, but also for the moving of the lifting gear from one place to another. If the handle is in the starting position, the lifting gear according to the invention is used like a lifting gear known from the prior art, i.e., without additional handle with little space requirement. The handle is then only swiveled out from its starting position into an operating position when necessary.

According to one exemplary embodiment, the handle of the lifting gear is movable about a swivel axis of the articulated joint which is disposed at an angle to a longitudinal axis of the lever arm, especially an angle of 90°. The arrangement of the handle about a swivel axis standing perpendicular to the longitudinal axis of the lever arm allows the handle to be placed in a position so that it is easily grabbed to enable an optimal application of force to the traction drive.

Preferably the handle is designed as a hollow grip body, while the grip body can be secured by an interior spring at least indirectly with respect to the articulated joint. Thanks to the design of the handle as a hollow grip body it is possible to protect the interior spring against dirt and/or corrosion. The movement of the handle occurs against the force of the spring. The force of the spring acts constantly in the direction of the articulated joint.

The grip body can be guided by a sleeve on a coupling element, wherein the sleeve is displaceable along the coupling element. A connection in the form of a plain bearing is produced as a result of the use of the sleeve inside the grip body. A combination of grip bodies made of plastic with sleeves made of metal is made possible. The spring extends along the coupling element. Because the sleeve can be displaced along the coupling element, the overall handle can be moved along the coupling element.

The articulated joint preferably comprises a bearing body and a fixation element, wherein the fixation element reaches through the bearing body and the coupling element and thus produces the swiveling connection between the bearing body and the coupling element. The direction of movement of the handle is determined by the orientation of the fixation element, i.e., the swivel axis. In particular, the handle can be moved out from the lever arm into a position parallel with the swivel axis of the lever arm.

The spring is arranged inside the grip body between the sleeve and an abutment body, while the spring presses the sleeve against the bearing body of the articulated joint. An unintentional movement of the handle with respect to the articulated joint may thus be avoided, since the preset tension of the spring has to be overcome in order to move the handle with respect to the articulated joint.

According to another exemplary embodiment, the bearing body has a cavity and the sleeve engages by a centering shoulder in the cavity of the bearing body, wherein a releasable force locking and/or form fit connection can be produced.

At one free end of the grip body there may be provided an opening, which receives a closure body. Thanks to the closure body, it is easier to make the grip body, especially when it involves an injection-molded plastic part.

BRIEF DESCRIPTION OF THE DRAWINGS

For an understanding of embodiments of the disclosure, reference is now made to the following description taken in conjunction with the accompanying drawings, in which.

In the figures, the same or like components are designated by the same reference signs, even if a repeated description of said components is dispensed with for reasons of simplicity.

DETAILED DESCRIPTION OF SOME EMBODIMENTS

Some embodiments will be now described with reference to the Figures.

Figure 1:
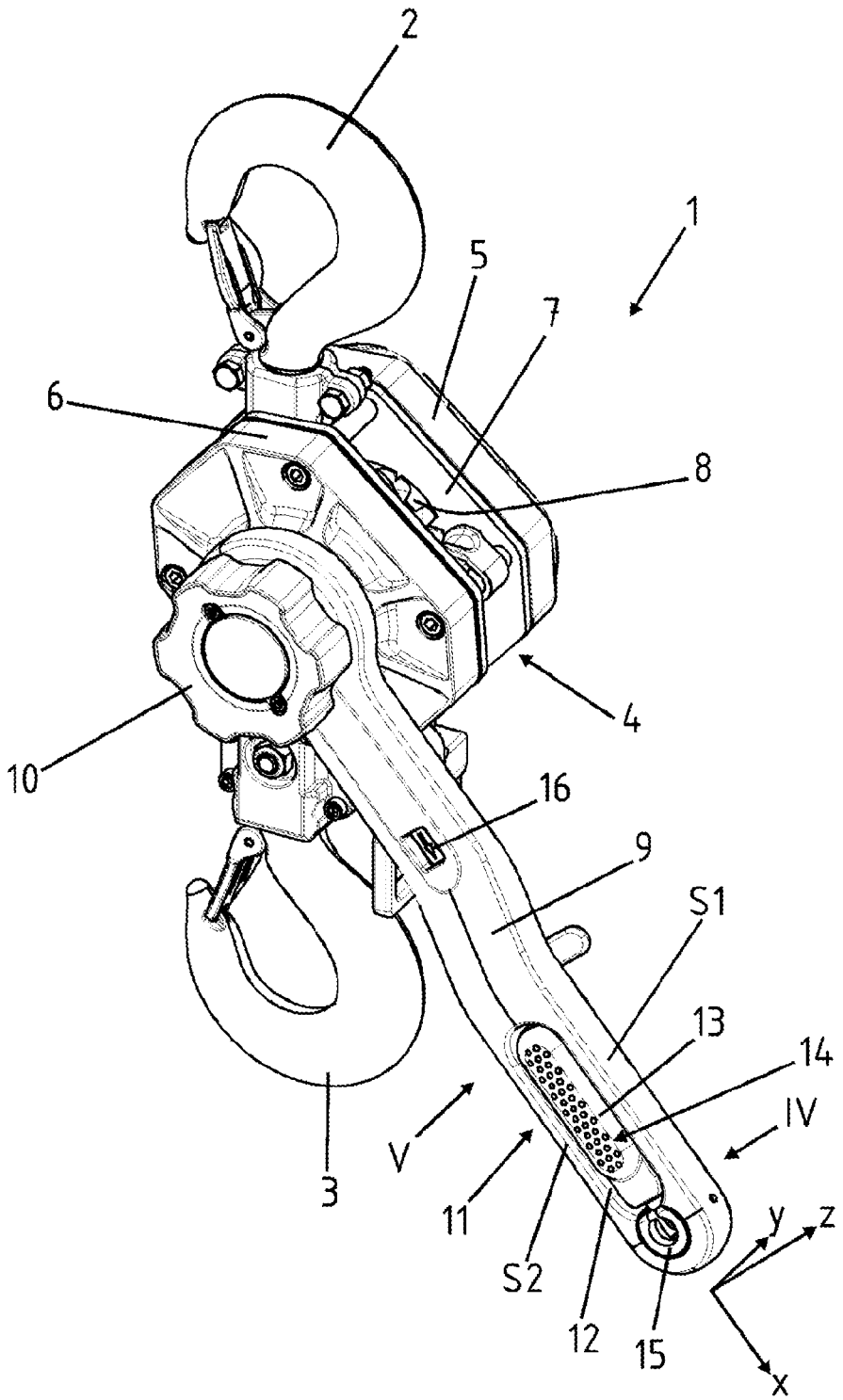
FIG. 1 is a perspective view of the lifting gear according to one exemplary embodiment, in which the handle is in the starting position.
Figure 3:
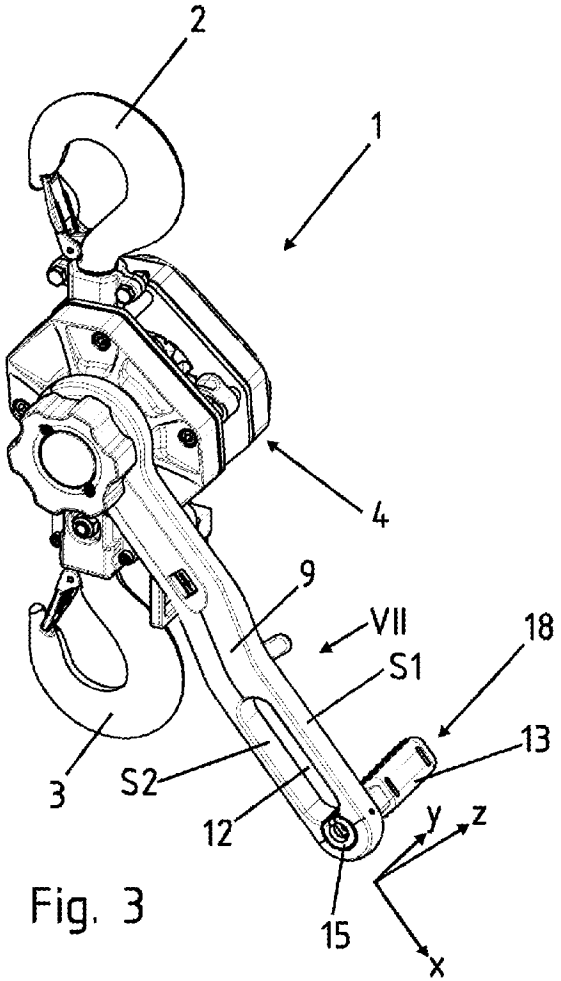
FIG. 3 is a perspective view of the lifting gear according to one exemplary embodiment, in which the handle is swiveled into a second operating position.
Figure 2:
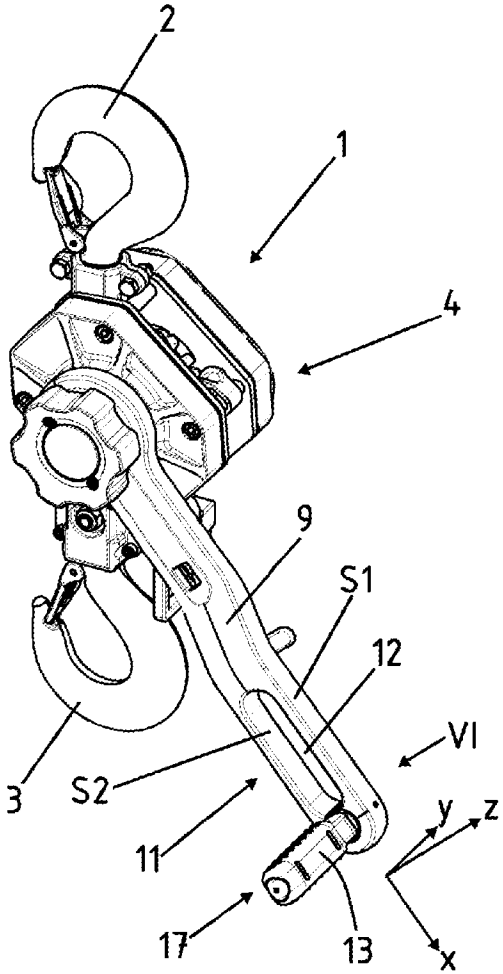
FIG. 2 is a perspective view of the lifting gear according to one exemplary embodiment, in which the handle is swiveled into a first operating position.

In FIGS. 1, 2 and 3, a variant embodiment of the lifting gear 1 according to the invention is denoted by 1. The lifting gear 1 comprises an upper fastening element 2 as well as a lower abutment element 3, which are joined together at least indirectly by a housing 4. The housing 4 in the present variant embodiment comprises two plates 5, 6 and a frame 7. Inside the housing 4 there is arranged a traction drive 8, by which a traction means, not otherwise represented, can be moved. The lower abutment element 3 is arranged on this traction means, and can be moved with the traction means.

The lever arm 9 is connected by a hand wheel 10 to a shaft and a gearing arrangement, not represented. By the gearing arrangement, the swiveling movement of the lever arm 9 is converted into a rotational movement of the traction drive 8, by which the traction means is moved. The lever arm 9 has a recess 12 at its free end 11. A handle 13 is located inside the recess 12 in a starting position 14 and is coupled by an articulated joint 15 to the lever arm 9. Furthermore, an adjustment unit 16 is arranged on the lever arm 9, being able to adjust the freewheeling direction of the lever arm 9.

The handle 13 in a starting position 14 is received between two webs S1, S2 of the lever arm. The webs S1, S2 enclose the recess 12 on two sides.

FIG. 2 shows that the handle 13 is in a first operating position 17 at the free end 11 of the lever arm 9. The handle 13 swivels by 90° out from the recess 12 between the webs S1, S2 to the left in the plane of the drawing into the first operating position 17.

FIG. 3 shows the lifting gear 1 according to the invention from FIGS. 1 and 2, where the handle 13 however is swiveled by 90° to the right in the plane of the drawing out from the recess 12 between the webs S1, S2 into a second operating position 18.

The variant embodiments represented in FIGS. 2 and 3 allow an operator to operate the lifting gear 1 according to the invention or the handle 13 connected to it by an articulated joint 15 with the left as well as the right hand, and without having to change his position with respect to the lifting gear 1. Thus, the operator can maintain an optimal position for performing the swivel movement of the lever arm 9.

Figure 4:
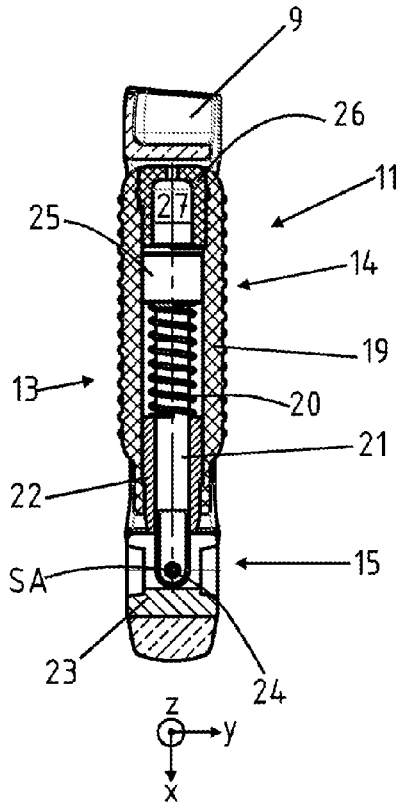
FIG. 4 is a cross section through the x-z plane of the free end of the lever arm, looking in the direction of the arrow IV of FIG. 1, where the handle is arranged in its starting position.

Furthermore, FIG. 4 shows a cross section representation along the longitudinal axis L of the lever arm 9, where the handle 13 is arranged in the recess of the free end 11 of the lever arm 9 in the starting position 14. The system of coordinates in the figures shows the position of the cross section planes.

The cross section representation makes it clear that the handle 13 possesses a hollow grip body 19. The hollow grip body 19 receives an interior spring 20, which is coupled by a coupling element 21 as well as a sleeve 22 to the articulated joint 15. In the variant embodiment as per FIG. 4, the articulated joint 15 is formed by a bearing body 23, while a fixation element 24 reaches through the bearing body 23 as well as the coupling element 21 and joins them to each other in swiveling manner. The angle W between the longitudinal axis L of the lever arm 9 and the swivel axis SA of the articulated joint 15 is 90° here, thereby achieving an ergonomically gripping position.

In the upper region of the handle 13 in the plane of the drawing of FIGS. 3 and 4 there is arranged an abutment 25. The grip body 19 is braced against the abutment 25 at its circumference. The biasing of the spring 20 can be adjusted by the size and position of the abutment 25. In this sample embodiment, the abutment 25 forms a single piece of material with the coupling element 21. The biasing force is thereby determined. Furthermore, FIG. 4 shows an opening 27 situated in the grip body 19, in which a closure body 26 of the grip body 19 is arranged. The closure body 26 closes the grip body 19 at the end face.

Figure 5:
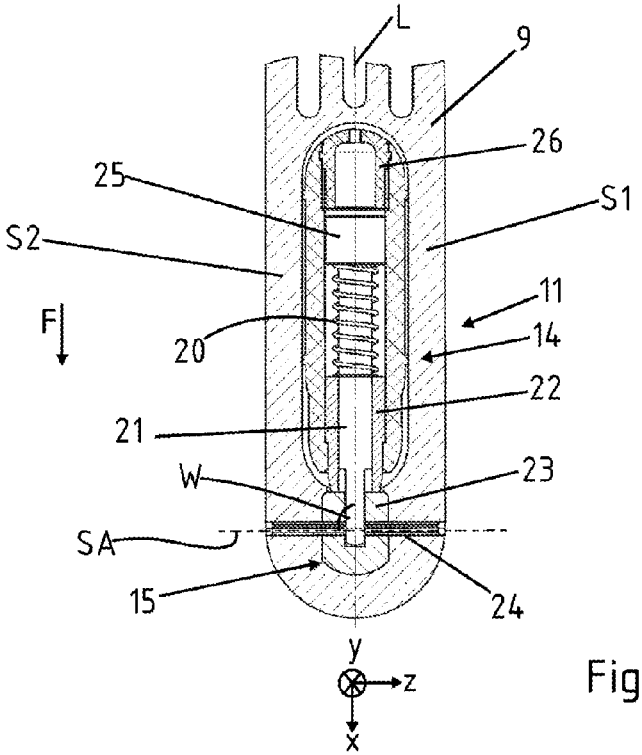
FIG. 5 is a cross section through the x-y plane of the free end of the lever arm, looking in the direction of the arrow V of FIG. 1, where the handle is arranged in a starting position.

FIG. 5 shows a cross section representation of the free end 11 of the lever arm 9 of FIG. 4 which has been swiveled by 90°. The fixation element 24 has been led through both the bearing body 23 of the articulated joint 15 and through the coupling element 21 and it joins these together. The force applied by the spring 20 in the force direction F, which runs from top to bottom in the direction of the figure along the longitudinal axis L of the lever arm 9, presses the grip body 19 into its starting position 14 via the sleeve 22.

Figure 6:
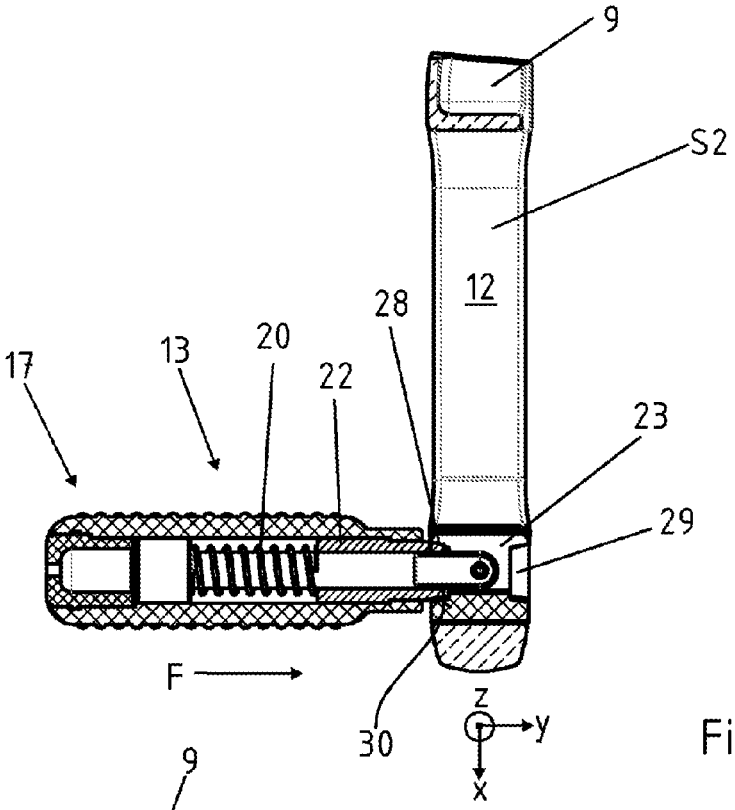
FIG. 6 is a cross section through the x-y plane of the free end of the lever arm, looking in the direction of the arrow VI of FIG. 2, where the handle is swiveled into the first operating position; and, FIG. 7 is a cross section through the x-y plane of the free end of the lever arm, looking in the direction of the arrow VII of FIG. 3, where the handle is swiveled into the second operating position.

FIG. 6 shows the position of the handle 13 in a first operating position 17, the handle 13 being situated in a horizontal orientation with respect to the bearing body 23 and extending to the left in the plane of the drawing. The sleeve 22 in the first operating position 17 is in engagement with a first cavity 28 of the bearing body 23. The sleeve 22 is pressed by the spring 20 into the first cavity 28 and is held there by its centering shoulder 30 in a form fit and force locking manner. The force of the spring 20 in the variant embodiment shown extends from the left side of the drawing to the right side of the drawing in the force direction F. The recess 12 between the webs S1, S2 of the lever arm 9 is not blocked and can thus be used as a purchase for the operator's other hand.

Figure 7:
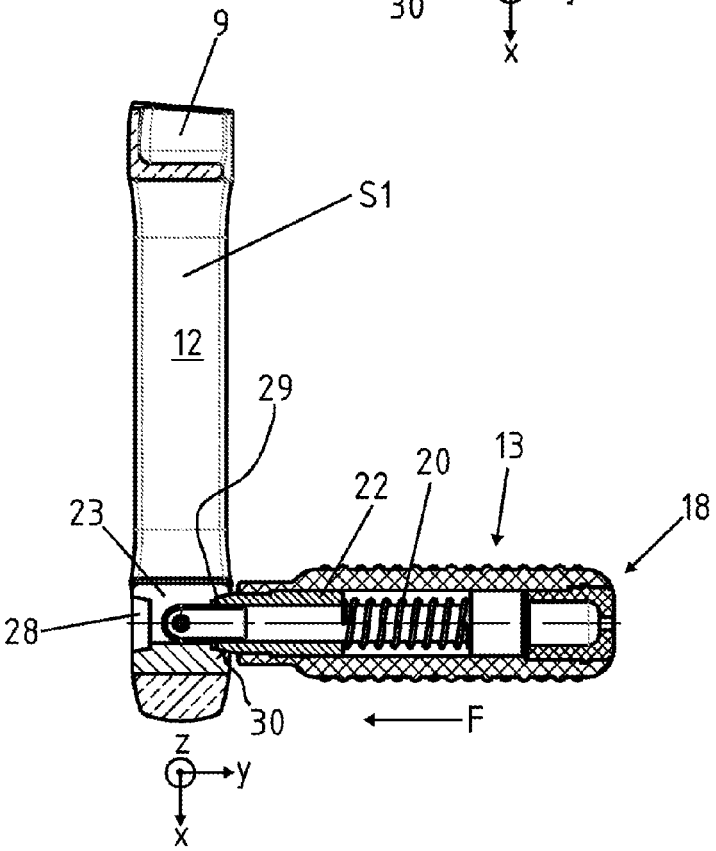

FIG. 7 shows the handle 13 in its second operating position 18, where the handle 13 is arranged horizontally in the direction of the drawing to the right of the bearing body 23. The sleeve 22 of the handle 13 is centered and pressed by the spring 20 in the second cavity 29 of the bearing body 23 and is held by force locking and form fit in the second cavity 29 in the second operating position 18. Here as well the recess 12 between the webs S1, S2 of the lever arm 9 is not blocked and thus likewise enables a grasping by the operator with his other hand. The force direction F of the force applied by the spring 20 runs here from right to left in the direction of the drawing.

The foregoing description of some embodiments of the invention has been presented for purposes of illustration and description. It is not intended to be exhaustive or to limit the invention to the precise form disclosed, and modifications and variations are possible in light of the above teachings or may be acquired from practice of the invention. The specifically described embodiments explain the principles and practical applications to enable one ordinarily skilled in the art to utilize various embodiments and with various modifications as are suited to the particular use contemplated. It is intended that the scope of the invention be defined by the claims appended hereto, and their equivalents. Further, it should be understood that various changes, substitutions and alterations can be made hereto without departing from the spirit and scope of the invention as described by the appended claims.

The invention claimed is:

1. A lifting gear, comprising:

a traction drive, a lever arm, wherein the traction drive is actuated by the lever arm arranged such that the lever arm is swivelable, a handle, wherein the handle is connected to the lever arm at a free end of the lever arm by an articulated joint, wherein the handle is swivelable from a starting position to an operating position, and wherein the lever arm has a recess open to both opposite surfaces of the lever arm, and the handle in the starting position is fully incorporated into the recess of the lever arm.

2. The lifting gear as claimed in claim 1, wherein the handle is movable about a swivel axis of the articulated joint, and the articulated joint is disposed at an angle to a longitudinal axis of the lever arm.

3. The lifting gear as claimed in claim 1, further comprising:

an interior spring, wherein the handle is a hollow grip body secured by the interior spring at least indirectly with respect to the articulated joint.

4. The lifting gear as claimed in claim 3, further comprising:

a coupling element, and a sleeve, wherein the grip body is connected by the sleeve to the coupling element, and wherein the sleeve is displaceable along the coupling element.

5. The lifting gear as claimed in claim 4, wherein the articulated joint comprises a bearing body and a fixation element, and wherein the fixation element extends through the bearing body and the coupling element and produces a swiveling connection between the bearing body and the coupling element.

6. The lifting gear as claimed in claim 4, wherein the spring is arranged inside the grip body between the sleeve and an abutment, while the spring presses the sleeve against the bearing body of the articulated joint.

7. The lifting gear as claimed in claim 5, wherein the bearing body has a cavity which accommodates the sleeve when the sleeve is pressed by the spring, and the spring is held in the cavity by a centering shoulder in the operating position, to produce a releasable force locking and/or a form fit connection.

8. The lifting gear as claimed in claim 6, further comprising:

a closure body, wherein a free end of the grip body has an opening, which receives the closure body.

9. The lifting gear as claimed in claim 4, wherein the sleeve has a centering shoulder.

10. The lifting gear as claimed in claim 1, wherein the lifting gear is a lever hoist.

11. The lifting gear as claimed in claim 1, further comprising:

a chain, a rope, or a wire movable by said traction device.

* * * * *